US005839771A

United States Patent [19]

DeMars

[11] Patent Number: 5,839,771

[45] Date of Patent: Nov. 24, 1998

[54] TOTE FOR CLEANING SUPPLIES

[76] Inventor: Robert A. DeMars, 5000 N. Parkway Calabasas, Suite 233, Calabasas, Calif. 91302

[21] Appl. No.: 752,656

[22] Filed: Nov. 19, 1996

[51] Int. Cl.[6] ..... B65D 85/62

[52] U.S. Cl. ..... 294/146; 206/225; 206/373; 220/555

[58] Field of Search ..... 294/142–144, 294/146, 159; 15/257.01; 206/223, 225, 229, 372, 373, 557, 561, 576, 581; 211/13.1, 71, 113, 126.1; 220/503, 505, 553, 555

[56] References Cited

U.S. PATENT DOCUMENTS

| | | | |
|---|---|---|---|
| 892,969 | 7/1908 | Wilson | 294/146 X |
| 3,887,103 | 6/1975 | Spooner | 294/146 X |
| 4,280,643 | 7/1981 | Cordova et al. | 294/146 X |
| 4,475,660 | 10/1984 | Cain | 294/143 X |
| 4,613,041 | 9/1986 | Carlton | 206/373 |
| 4,887,713 | 12/1989 | Tupper | 206/225 |
| 5,035,321 | 7/1991 | Denton | 206/225 |
| 5,207,321 | 5/1993 | Jones | 206/223 |

*Primary Examiner*—Johnny D. Cherry
*Attorney, Agent, or Firm*—Jack C. Munro

[57] ABSTRACT

The subject invention comprises a tote for cleaning utensils and supplies which has a base that includes an open internal compartment to be used to contain cleaning supplies and tools. A pair of sidewalls is attached to the base and extends upwardly therefrom in a spaced-apart relationship. Between the sidewalls is to be mounted on brackets a roll of paper towels. Mounted on the sidewalls is a hanger with this hanger to support a bag within which is to be deposited waste. Connected between the upper end of the sidewalls is a carry handle.

4 Claims, 2 Drawing Sheets

TOTE FOR CLEANING SUPPLIES

BACKGROUND OF THE INVENTION

1) Field Of The Invention

This invention relates to a tote comprising a carrying container for conveniently transporting multiple articles intended to be used for a single purpose and more particularly to a carrying container for cleaning supplies to be used by individuals performing cleaning services.

2) Description Of The Prior Art

Carrying containers, commonly referred to as totes, of various types have long been known. There have also been known carrying containers for maids, homeowners and other individuals engaged in performing cleaning operations within a home or business. Such cleaning carrying containers in the past have been bulky in design and size, and inefficient for the carrying of different articles required by an individual performing cleaning tasks. By way of example, in a typical cleaning procedure, there are customarily required containers of furniture wax, glass cleaner, spot remover and scouring cleaner, as well as rags and paper towels and a bag into which used disposable towels can be discarded. Also, the tote should accommodate desired cleaning tools such as brushes and sponges and consumable type items such as a roll of paper toweling and an open bag for disposal of used paper towels. Prior to the present invention there has not been known any tote in which most of the articles customarily desired to facilitate cleaning operations can be carried conveniently by the individual within a single carrying container.

SUMMARY OF THE INVENTION

The subject matter of the present invention comprises a tote in the form of a container which includes a base. The base is constructed of a bottom wall to which are fixedly attached enclosing sidewalls with the base being open at the top. The enclosing sidewalls form an internal compartment. That internal compartment may be divided into a main compartment into which cans, jars, bottles and rags can be located and also a smaller compartment into which the cleaning tools are to be located. Fixedly secured to the base and extending from opposite sides thereof is a pair of upstanding sidewalls. These sidewalls are to have mounted therebetween a roll of paper towels. The upper ends of the sidewalls are connected together by a bar which constitutes a carrying handle. Also attached to the sidewalls is a hanger with this hanger being constructed to support a bag in an open position with this bag being located exteriorly of the internal compartment. The hanger could be separate and removable from the sidewalls or made integral with the sidewalls.

One of the primary objectives of the present invention is to construct a tote for cleaning materials which can be manufactured relatively inexpensively and thereby have both a convenience appeal and a comparatively inexpensive price.

Another objective of the present invention is to construct a tote for cleaning materials which facilitates the carrying of different types of cleaning supplies and rags, cleaning tools such as brushes and sponges, as well as a supply of paper towels which is mounted ready for immediate usage and further supports a bag in an open configuration which facilitates disposal of the towels or rags as they are used.

DETAILED DESCRIPTION OF THE PREFERRED EMBODIMENTS

Figure 1:
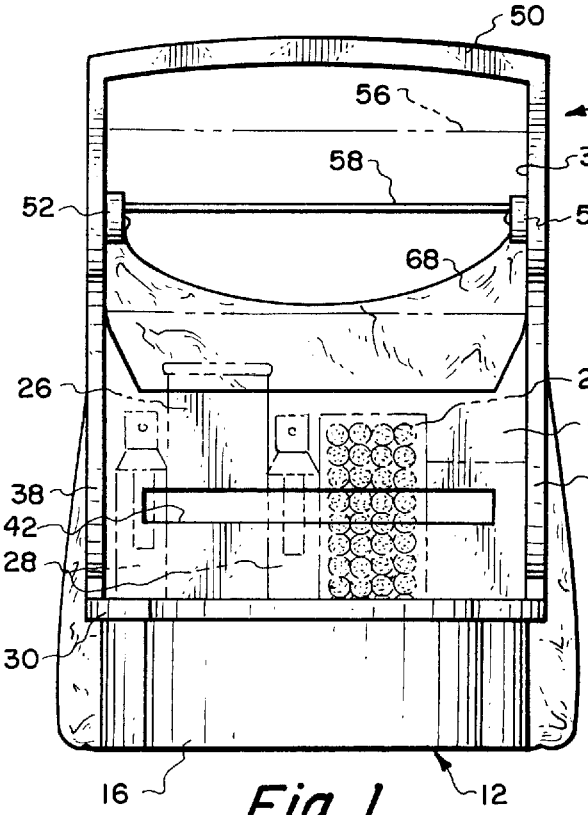
FIG. 1 is a front elevational view of the first embodiment of tote of the present invention.
Figure 2:
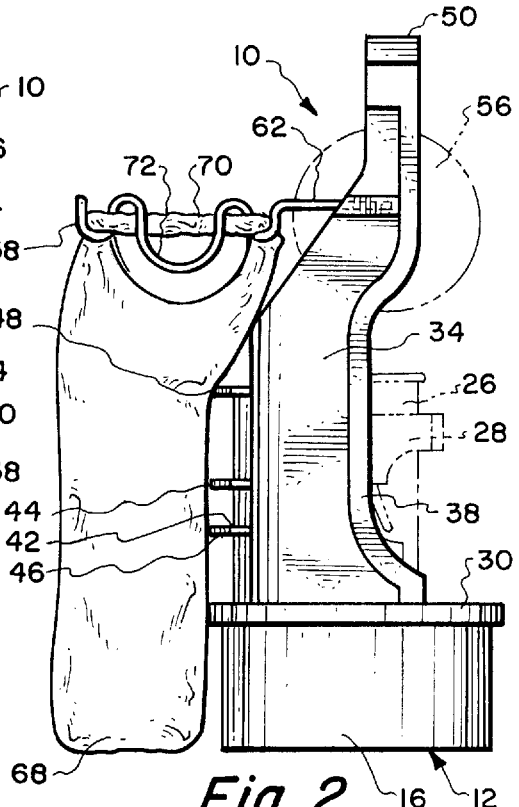
FIG. 2 is a left side view of the first embodiment of tote of the present invention.
Figure 3:
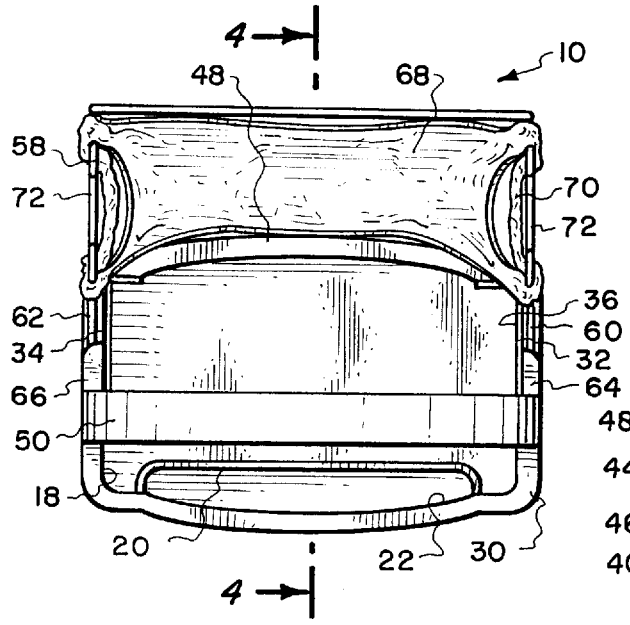
FIG. 3 is a top plan view of the first embodiment of tote of the present invention.
Figure 4:
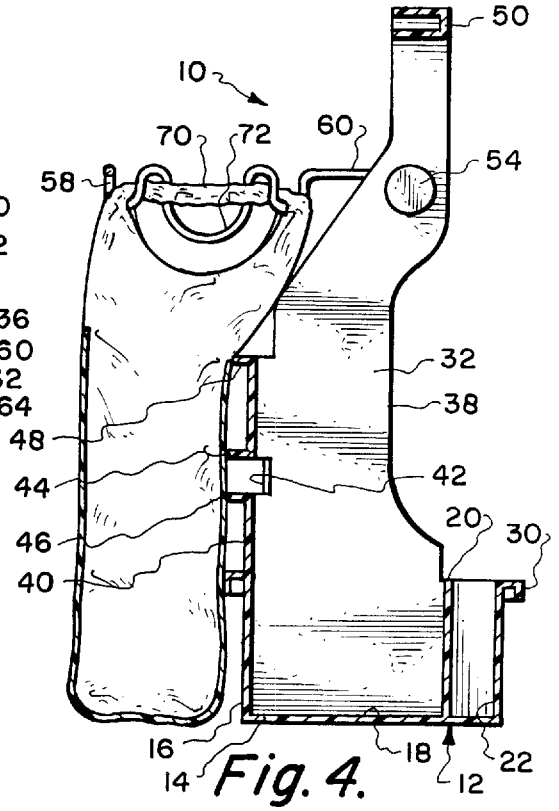
FIG. 4 is a cross-sectional view of the first embodiment of tote taken along line 4—4 of FIG. 3.

Referring particularly to FIGS. 1–4 of the drawings, there is shown a first embodiment of tote 10 of this invention. The tote 10 is formed of a rigid material which would commonly be constructed of plastic. The base 12 includes a planar bottom 14. Fixedly secured to the peripheral edge of the bottom 14 is an enclosing sidewall 16. Particularly the bottom 14 and sidewall 16 will be constructed of material about one-eighth of an inch thick. The length of the base 12 will be approximately twelve inches with the width of the base being about seven inches.

Base 12 defines an internal compartment 18. The internal compartment 18 has a dividing wall 20 mounted therein. The dividing wall 20 separates the internal compartment 18 into a main section and a smaller compartment 22. Within the smaller compartment 22 there are to be supported cleaning tools such as brushes 24, sponges and other similar types of cleaning tools. Within the main portion of the internal compartment 18 there are to be located cans, jars or bottles 26 of cleaning substances. A glass cleaner container 28 is also to be located within the main portion of the internal chamber 18.

The open upper ends of the base 12 are formed into a lip 30. It is the function of the lip 30 to provide strength to the base 12. Fixedly secured to the lip 30 and extending upwardly away from the base 12 is a pair of sidewalls 32 and 34. One of the sidewalls 32 is to be attached at one end of the base 12 with the other sidewall 34 attached at the opposite end of the base 12. Located between the sidewalls 32 and 34 is a space 36 with the forward edge of each of the sidewalls 32 and 34 formed into a lip 38 which is basically similar in construction to the lip 30. Mounted between the sidewalls 32 and 34 and attached to the bottom 14 is a back wall 40. For strength reasons, there is inserted an opening 42 within the back wall 40 from which extend outwardly flanges 44 and 46. The flanges 44 and 46 substantially increase the strength of the back wall 40. The top edge of the back wall 40 has mounted thereon a flange 48 which also is for the purpose of strengthening the back wall 40.

The upper end of the sidewalls 32 and 34 are connected together by a handlebar 50. It is the function of the handlebar 50 to facilitate carrying of the tote 10 of this invention by a human. This carrying is to be accomplished by the user picking up the tote 10 by utilizing handlebar 50.

Mounted on the interior surface of the sidewall 34 is a bracket 52. A similar such bracket 54 is mounted on the interior surface of the sidewall 32. The brackets 52 and 54 are identical and are located in a facing relationship relative to each other. Each of the brackets 52 and 54 constitutes a round protusion resembling the shape of a disc. The brackets 52 and 54 are in alignment with each other. The center core of a roll of paper towels 56 is to be mounted between the brackets 52 and 54. There is to be a loose fit between the center core of the roll of paper towels 56 and the brackets 52 and 54 which will permit the roll of paper towels 56 to rotate on the brackets 52 and 54 for the purpose of dispensing individual towels. Installation of the roll of paper towels 56 on the brackets 52 and 54 can be accomplished by slight manual spreading apart of the sidewalls 32 and 34.

A wire metal hanger 58 is formed into a U-shaped configuration and has depending legs 60 and 62. The leg 60 is located within a tube 64 mounted on the exterior surface of the sidewall 32. In a similar manner the leg 62 is mounted within a tube 66 mounted on the exterior surface of the sidewall 34. The outer end of each of the legs 60 and 62 is formed into a short right angled section (not shown) with this right angled section being appropriately located through holes (not shown) formed within their respective sidewalls 32 and 34. This will permanently mount the hanger 58 in a fixed position relative to the sidewalls 32 and 34. The open mouth end 70 of a waste collection bag 68 is to be draped under hook sections 72 of the hanger 58. There are two in number of the hook sections 72 located on opposite sides of the hanger 58 with one hook section 72 directly connecting with leg 60 and the other hook section 72 connecting with leg 62. Hook sections 72 are for the purpose of fixedly locating the bag 68 on the hanger 58.

With the bag 68 in the open configuration as shown in the drawing, the sidewall of the bag 68 will rest against the back wall 40 and against the flanges 44, 46 and 48. When it is desired to replace the bag 68, it is only necessary to unhook the open mouth end 70 of the bag 68 from the hook sections 72 and then discard the bag 68 and its contents. At that particular time, a new bag 68 can then be placed in conjunction with the hook section 72. During shipping of the tote 10, the hanger 58 is to be disengaged from the tubes 64 and 66 and the hanger 58 can then be stored within the internal compartment 18.

Figure 5:
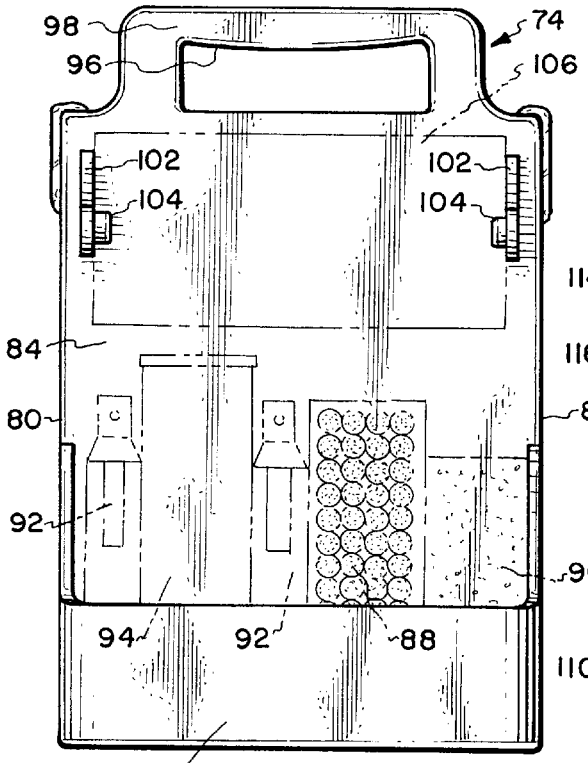
FIG. 5 is a front elevational view of the second embodiment of tote of the present invention.
Figure 6:
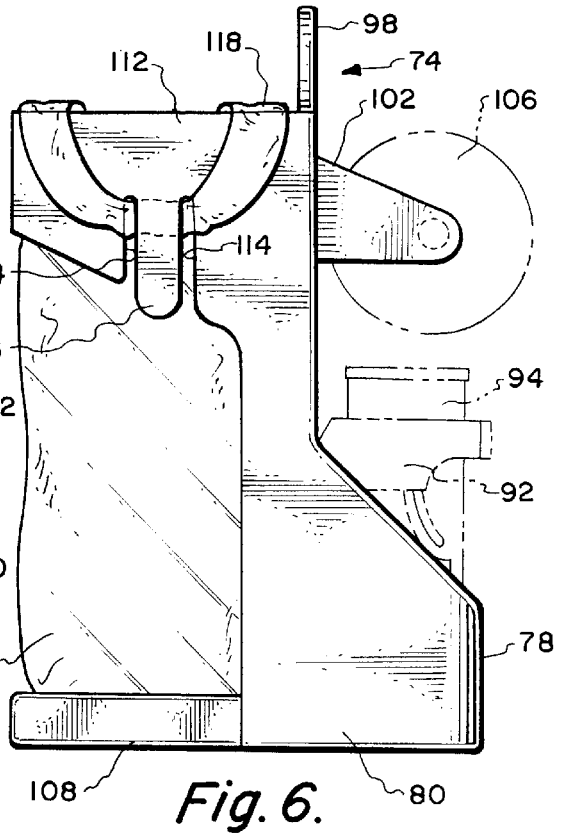
FIG. 6 is a left side view of the second embodiment of tote of the present invention.
Figure 7:
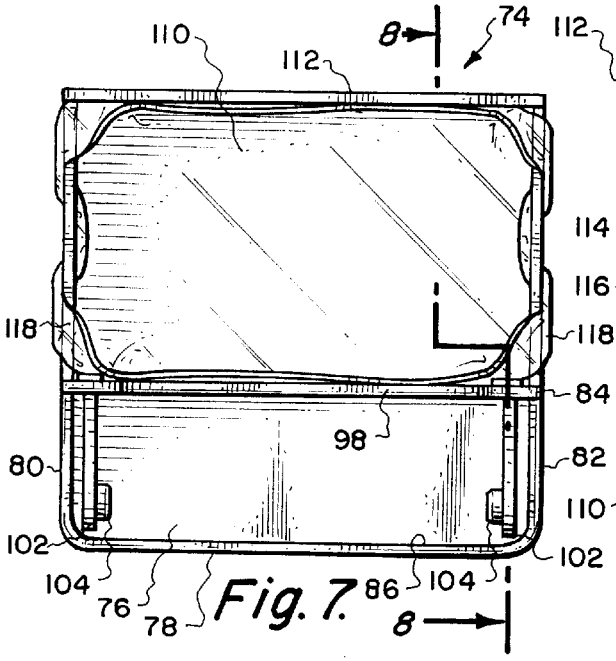
FIG. 7 is a top plan view of the second embodiment of tote of the present invention.
Figure 8:
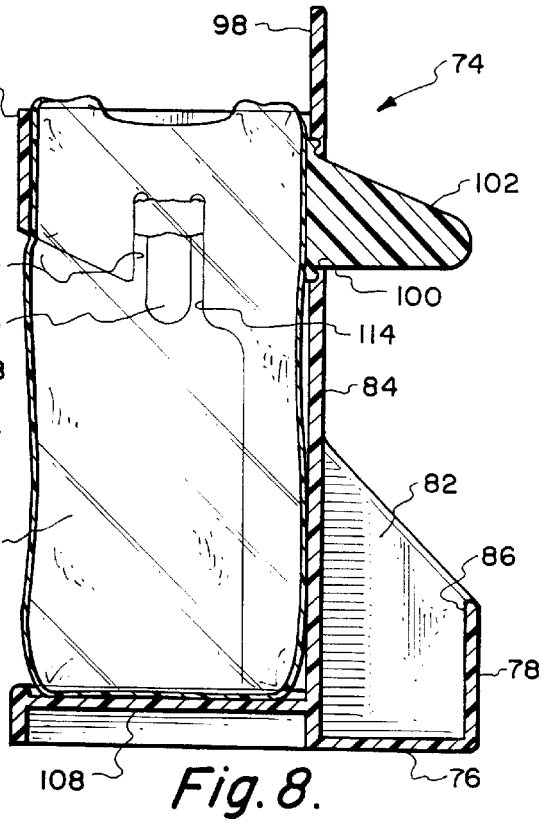
FIG. 8 is a cross-sectional view of the second embodiment of tote taken along line 8—8 of FIG. 7.

Referring particularly to FIGS. 5–8 of the drawings, there is shown the second embodiment of tote 74 of this invention. The tote 74 incorporates a base which includes a planar bottom 76. Fixedly secured to the outward peripheral edge of the planar bottom 76 is a front wall 78. Integrally secured to one side edge of the planar bottom 76 is a sidewall 80 with another sidewall 82 being integrally secured to the opposite side edge of the planar bottom 76. Between the sidewalls 80 and 82 and extending from the planar bottom 76 is a back wall 84. The back wall 84 combines with sidewalls 80 and 82 and front wall 78 to form an internal compartment 86. Within the internal compartment 86 there are to be located cleaning tools such as a brush 88 and sponge 90, as well as cleaning supplies such as bottles 92 and can 94, each of which is to contain cleaning substances plus some cleaning rags. The internal compartment 86 could be divided between a main compartment and a small compartment as is shown in conjunction with the first embodiment of this invention.

The upper end of the back wall 84 includes an enlarged opening 96. The enlarged opening 96 functions in conjunction with the back wall 84 to form a handle 98. The handle 98 is to facilitate the carrying of the second embodiment 74 from one location to another.

Formed through the back wall 84 directly adjacent the enlarged opening 96 is a pair of spaced apart openings 100 with only one being shown. Mounted in conjunction with each spaced apart opening 100 is a bracket 102. Each bracket 102 includes a protuberance 104. The protuberances 104 of the brackets 102 are to be facing each other and in alignment. The center core of a roll of paper towels 106 is to be supported on the protuberances 104 and mounted between the brackets 102. It is to be understood that the brackets 102 will be disengaged from their respective openings 100 during shipping of the second embodiment 74 of this invention. It is also to be understood that the roll 106 is to be supplied separately from the second embodiment 74 of this invention.

A platform 108 is attached to the back wall 84, extending horizonally therefrom in a direction opposite of the planar bottom 76 but almost in alignment with planar bottom 76. The bottom of a waste disposal bag 110 is to be mounted on the platform 108. The waste disposal bag 110 could comprise plastic or paper. If the waste disposal bag 110 happens to be paper, the upper surface of the waste disposal bag 110 is to be located within enclosing frame 112 which is integrally mounted to the sidewalls 80 and 82. A waste disposal bag 110 generally has sufficient wall strength to stand upright without support. The enclosing frame 112 is located directly adjacent the enlarged opening 96. The enclosing frame 112 also includes a pair of slots 114 formed within each side of the enclosing frame 112. Between the slots 114 of each side of the enclosing frame 112 is located a tongue 116. If the waste disposal bag 110 happens to be constructed of a plastic with insufficient sidewall strength to stand in the upright position on the platform 108, the handles 118 of the waste disposal bag 110 are each to be draped over opposite sidewalls of the enclosing frame 112 with each handle 118 slipped under a tongue 116. This will secure the waste disposal bag 110 in position within the second embodiment 74 and position the waste disposal bag 110 in a continuously open configuration ready to receive waste.

What is claimed is:

1. A tote for cleaning utensils and supplies comprising:

a base having an internal compartment formed by an enclosing wall located about a bottom wall, said base having an open top, said base having an exterior wall surface;

a pair of upstanding sidewalls having a bottom edge fixed to said base, said sidewalls extending from said base and located in a spaced apart relationship forming a space therebetween, said upstanding sidewalls having a top edge, a handle secured to said top edge of both said sidewalls and extending therebetween;

a back wall extending between said upstanding sidewalls, said back wall being in alignment with a portion of said enclosing wall, said back wall having a back side and a front side, said front side being in alignment with said internal compartment, said back side being in alignment with said exterior wall surface;

a hanger mounted on each said sidewall, said hanger adapted to support a bag in an open configuration which is to rest against said back side of said back wall; and a bracket mounted on each said sidewall and located within said space, said brackets being in alignment, said brackets located directly adjacent said handle, said brackets adapted to support a roll of paper towels.

2. The tote as defined in claim 1 wherein:

said internal compartment including a separate small article compartment.

3. The tote as defined in claim 1 wherein:

said back wall is mounted on said base.

4. The tote as defined in claim 1 wherein:

said hanger is removable from said sidewalls.

* * * * *